US006963715B2

(12) United States Patent
Kanekura et al.

(10) Patent No.: US 6,963,715 B2
(45) Date of Patent: Nov. 8, 2005

(54) IMAGE TRANSFER SECTION OF COLOR IMAGE FORMING APPARATUS

(75) Inventors: Kazunori Kanekura, Chikushino (JP); Kazuhiro Seguchi, Kurume (JP); Yuji Nagai, Kurume (JP); Yuzo Kawano, Ogori (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/452,760

(22) Filed: Jun. 2, 2003

(65) Prior Publication Data

US 2003/0223785 A1 Dec. 4, 2003

(30) Foreign Application Priority Data

Jun. 3, 2002 (JP) ..... P. 2002-161187
Sep. 12, 2002 (JP) ..... P. 2002-266727

(51) Int. Cl.[7] ..... G03G 15/00
(52) U.S. Cl. ..... 399/299; 399/306
(58) Field of Search ..... 399/299, 300, 399/302, 308, 307

(56) References Cited

U.S. PATENT DOCUMENTS

| | | | | |
|---|---|---|---|---|
| 5,541,634 | A * | 7/1996 | Otsuka et al. | 347/119 |
| 6,470,166 | B2 * | 10/2002 | Mizoguchi et al. | 399/302 |
| 6,477,348 | B2 * | 11/2002 | Miyamoto et al. | 399/299 |
| 6,477,349 | B2 | 11/2002 | Kanekura et al. | |
| 6,724,410 | B2 * | 4/2004 | Arai | 347/115 |
| 2002/0018673 | A1 | 2/2002 | Mizoguchi et al. | |
| 2003/0219288 | A1 * | 11/2003 | Hagiwara et al. | 399/299 |

FOREIGN PATENT DOCUMENTS

| | | |
|---|---|---|
| JP | 5-061316 | 3/1993 |
| JP | 05-088501 | 4/1993 |
| JP | 08-123130 | 5/1996 |
| JP | 10-293437 | 11/1998 |
| JP | 2001-005305 | 1/2001 |
| JP | 2001-296716 | 10/2001 |
| JP | 2001-296718 | 10/2001 |
| JP | 2001-318540 | 11/2001 |
| JP | 2002-006623 | 1/2002 |
| JP | 2002-006716 | 1/2002 |
| JP | 2002-91199 | 3/2002 |

* cited by examiner

*Primary Examiner*—Quana Grainger
(74) *Attorney, Agent, or Firm*—Pearne & Gordon LLP

(57) ABSTRACT

A color image forming apparatus comprises photoconductor drums on which toner images of each color are developed and formed; an endless intermediate transfer belt arranged in a contactable state with the photoconductor drums to run; first bias transfer rollers which perform first bias transfer in which the toner images of each color are transferred from the photoconductor drums onto the intermediate transfer belt; a second bias transfer roller which performs second transfer in which the toner images on the intermediate transfer belt are transferred onto paper; and a separation unit which, when a maximum print length of an image is below a length from a transfer point A to a transfer point B, separates the photoconductor drums and the intermediate transfer belt from each other after all first bias transfer of the toner images to be transferred on the last paper in a first print job has been completed, before second bias transfer onto the last paper is started and after second bias transfer onto paper immediately before the last paper has been completed.

10 Claims, 8 Drawing Sheets

IMAGE TRANSFER SECTION OF COLOR IMAGE FORMING APPARATUS

BACKGROUND OF THE INVENTION

The present invention relates to an electrophotographic type color image forming apparatus having an endless intermediate transfer member, and particularly to effective technology applied to prolongation of a photoconductor's life in a color image forming apparatus.

Conventionally, in an image forming apparatus adopting an electrophotographic form, a photoconductor that is an image carrying member is charged by a charger, the charged photoconductor is irradiated with light according to image data to form a latent image thereon, this latent image is developed by a developing device, and the developed toner image is transferred onto a recording medium, whereby an image is formed.

On the other hand, with colorization of image, a tandem type color image forming apparatus is also proposed, in which plural image forming units executing such each image forming process are provided, toner images of cyan, magenta, yellow, and preferably black are formed on the respective photoconductors, and these toner images are multi layer transferred onto an endless intermediate transfer member at a transfer position of each photoconductor, whereby a full color image is formed.

Since such the tandem type color image forming apparatus has image forming sections for each color, speed-up is advantageous.

A conventional tandem type color image forming apparatus will be described below.

FIG. 6 is a schematic view showing the constitution of the conventional color image forming apparatus 100.

In FIG. 6, in a body 1 of the color image forming apparatus, image forming units 102, 103, 104 and 105 for forming respectively toner images of each color of yellow (Y), magenta (M), cyan (C), and black (K) are arranged, and exposing devices 106*a,* 106*b,* 106*c,* and 10*d* respectively corresponding to the image forming units 102 to 105 are provided. The image forming units 102 to 105 include photoconductor drums (photoconductors) 102*a,* 103*a,* 104*a,* and 105*a* on peripheral surfaces of which electrostatic latent images are formed by irradiation of laser beams from the exposing devices 106*a* to 106*d;* and developing rollers 102*b,* 103*b,* 104*b,* and 105*b* which attach toner supplied from toner tanks onto the photoconductor drums 102*a* to 105*a* to make the electrostatic latent images visible as toner images.

On the lower side of the image forming units 102 to 105, an endless intermediate transfer belt (intermediate transfer member) 107 on which a color toner image is formed by multi layer transferring the toner images of the respective colors made visible on the photoconductor drums 102*a,* 103*a,* 104*a,* and 105*a* is arranged so that it can run in the direction of an arrow. The intermediate transfer belt 107 includes a drive roller 108, a tension roller 109, four first bias transfer rollers 110*a,* 110*b,* 110*c* and 110*d,* and a driven roller 111 in its loop.

At the lower portion of the apparatus, a paper supply cassette 113 storing paper (recording medium) P therein is provided. The paper P is fed out from the paper supply cassette 113 to a paper transport path one by one by a supply roller.

On the paper transport path, a second bias transfer roller 112 which comes into contact with the peripheral surface of the intermediate transfer belt 107 by the predetermined amount in the position of the driven roller 111 thereby to transfer the color image on the intermediate transfer belt 107 onto the paper P, and a fixing device 114 which fixes the color image transferred onto the paper P onto the paper P are arranged.

In the thus structured image forming apparatus, onto the surface of the intermediate transfer belt 107, the toner images of yellow, magenta, cyan and black adhere from the photoconductor drums 102*a* to 105*a* in the image forming units 102 to 105 and the color image is formed. This toner color image is transferred onto the paper P taken out of the sheet supply cassette 113 by the nip power between the driven roller 111 and the second bias transfer roller 112. Then, the paper P is supplied to the fixing device 114, the toner image is fixed thereon, and thereafter the paper P is exhausted.

In such the color image forming apparatus, the first bias transfer rollers 110*a* to 110*d* move to two positions up and down. One of their positions is a contact position where the first bias transfer rollers bring the intermediate transfer belt 107 into pressure contact with the photoconductor drums 102*a* to 105*a,* and the other is a separation position where the first bias transfer rollers separate the intermediate transfer belt 107 from the photoconductor drums 102*a* to 105*a*. The image forming units 102 to 105 stop after the first bias transfer rollers 110*a* to 110*d* have moved downward and the intermediate transfer belt 107 and the photoconductor drums 102*a* to 105*a* have separated from each other.

Here, when the intermediate transfer belt 107 and the photoconductor drums 102*a* to 105*a* are separating from each other, the state of the intermediate transfer belt 107 changes. Therefore, when the toner image on the intermediate transfer belt 7 is transferred onto paper P for this time, transfer error occurs. In order to prevent this transfer error, after the toner image on the intermediate transfer belt 107 has been transferred onto the paper P, the first bias transfer rollers 110*a* to 110*d* move downward, contact between the photoconductor drums 102*a* to 105*a* and the intermediate transfer belt 107 is released, and rotation drive of the image forming units 102 to 105 including the photoconductor drums 102*a* to 105*a* stops.

However, in the described-before related art, after the toner image on the intermediate transfer belt 107 has been transferred on the paper P, the separation between the photoconductor drums 102*a* to 105*a* and the intermediate transfer belt 107 is performed. Therefore, though the toner images on the photoconductor drums 102*a* to 105*a* have been already transferred on the intermediate transfer belt 107, the photoconductor drums 102*a* to 105*a* come into contact with the intermediate transfer belt 107. Further, the photoconductor drums 102*a* to 105*a* in the image forming units 102 to 105 and the developing units 102*b* to 105*b* are operating. Therefore, there is a problem that lives of the photoconductor drums 102*a* to 105*a* are shortened.

As described before, when the intermediate transfer belt 107 and the photoconductor drums 102*a* to 105*a* separate from each other, the state of the intermediate transfer belt 107 changes and transfer error occurs. Therefore, it is not possible to unnecessarily separate the intermediate transfer belt 107 and the photoconductor drums 2*a* to 5*a* from each other during printing.

Here, a lifting mechanism of the first bias transfer rollers 110*a* to 110*d* which the inventor has been investigated will be shown in FIG. 7.

FIG. 7A shows a state where all the first bias transfer rollers 110*a* to 110*d* descend and the intermediate transfer belt 107 separate from the photoconductor drums 102*a* to 105*a*.

When an instruction is given so that only the black image forming unit 105 operates in case that a monochrome image is formed, a drive motor (not shown) operates, and a second transmission shaft 117 is rotated. Then, as shown in FIG. 7B, a rise and fall rod 118*c* rises by a rise and fall cam 117*a,* and the first bias transfer roller 110*d* attached to this rise and fall rod 118*c* brings the intermediate transfer belt 107 into contact with the photoconductor drum 105*a.*

Further, when an instruction is given so that all the image forming units 102 to 105 operate in case that a color image is formed, first and second transmission shafts 116 and 117 are rotated. Then, as shown in FIG. 7C, rise and fall rods 118*b* rise by a rise and fall cam 116*a* through a horizontal rod 118*a,* and the rise and fall rod 118*c* rises by the rise and fall cam 117*a,* so that the first bias transfer rollers 110*a* to 110*d* attached to the rise and fall rods 118*b* and 118*c* bring the intermediate transfer belt 107 into contact with the photoconductor drums 102*a* to 105*a.*

In order to appropriately transfer a toner image formed on a photoconductor drum onto an intermediate transfer belt, it is necessary to bring the intermediate transfer belt into pressure contact with the photoconductor drum by the optimum contact power of a first bias transfer roller.

However, in the structure in which the first bias transfer roller is raised and let down by the before-mentioned link mechanism, the number of parts increases and accuracy is difficult to obtain, so that it is difficult to attempt optimization. Namely, since the number of elements for accuracy acquirement such as machining accuracy of the rise-and-fall cam and the transmission shaft, and a rotary fulcrum increases, it is difficult to bring the intermediate transfer belt into pressure contact with the photoconductor drum with the optimum contact power by the first bias transfer roller.

SUMMARY OF THE INVENTION

Therefore, an object of the invention is to provide a color image forming apparatus which can prevent the transfer error and prolong the photoconductor's life.

Another object of the invention is to provide a color image forming apparatus which can control height of contact of a first bias transfer roller with an intermediate transfer member at high accuracy.

In order to solve the above mentioned problem, according to first aspect of the invention, a color image forming apparatus comprises: a plurality of photoconductors arranged in a line so that their rotary center shafts become parallel with one another and rotating in the peripheral direction, on which electrostatic latent images corresponding to toner images of each color are formed respectively; developing units provided respectively correspondingly to the photoconductors and making the electrostatic latent images formed on the photoconductors visible to form toner images; an endless intermediate transfer member arranged in a contactable state with the photoconductors to run; first bias transfer rollers which are arranged in a loop of the intermediate transfer member respectively correspondingly to each photoconductor, and bring the intermediate transfer member into pressure contact with the photoconductors thereby to transfer the toner images of each color on the photoconductor onto the intermediate transfer member, that is, to perform first bias transfer; a second bias transfer roller which presses a recording medium against the intermediate transfer member thereby to transfer the toner image transferred on the intermediate transfer member onto the recording medium, that is, to perform second bias transfer; and a separation mechanism which, when a maximum print length of an image to be printed on the recording medium is below a length from a transfer point of the first bias transfer located on the most downstream side in the moving direction of the intermediate transfer member to a transfer point of second transfer in the moving direction of the intermediate transfer member, separates the photoconductors and said intermediate transfer member from each other after all first bias transfer of the toner images to be transferred on the last recording medium in a first print job has been completed, before second bias transfer onto the last recording medium is started and after second bias transfer onto a recording medium immediately before the last recording medium has been completed.

As described above, after all the first bias transfer in the first print job has been completed, before the last second bias transfer is started, and after second bias transfer onto a recording medium before one from the last recording medium has been completed, the photoconductors and the intermediate transfer member are separated from each other. Therefore, the state change of the intermediate transfer member due to separation between the intermediate transfer member and the photoconductor has no influence on printing, so that the transfer registration error can be prevented and the photoconductor's life can be prolonged.

According to second aspect of the invention, a color image forming apparatus comprises: a plurality of photoconductors arranged in a line so that their rotary center shafts become parallel with one another and rotating in the peripheral direction, on which toner images of each color are formed respectively; an endless intermediate transfer member arranged in a contactable state with said photoconductors to run; a plurality of first bias transfer rollers which are respectively arranged in a loop of the intermediate transfer member correspondingly to each photoconductor, and bring the intermediate transfer member into pressure contact with the photoconductors thereby to transfer the toner images of each color on the photoconductors onto the intermediate transfer member; guide grooves into which rotary shafts of the first bias transfer rollers are fitted, which can move the first bias transfer roller to two position comprising a contact position where the intermediate transfer member is brought into pressure contact with the photoconductors and a separation position where the intermediate transfer member is separated from the photoconductors; and a lift drive section which is provided so that it can reciprocate linearly in the arrangement direction of the plural first bias transfer rollers and which has cam noses supporting the rotary shafts of the first bias transfer rollers, and raising and letting down said first bias transfer rollers along the guide grooves thereby to move the first bias transfer rollers to the contact position or the separation position.

As described above, since the first bias transfer roller is raised or let down by the cam nose formed at the lift drive section reciprocating linearly, the lifting amount of the first bias transfer roller is determined by height of the cam nose, so that the height of contact of the first bias transfer roller with the intermediate transfer member can be controlled at high accuracy.

DETAILED DESCRIPTION OF THE PREFERRED EMBODIMENTS

Figure 1:
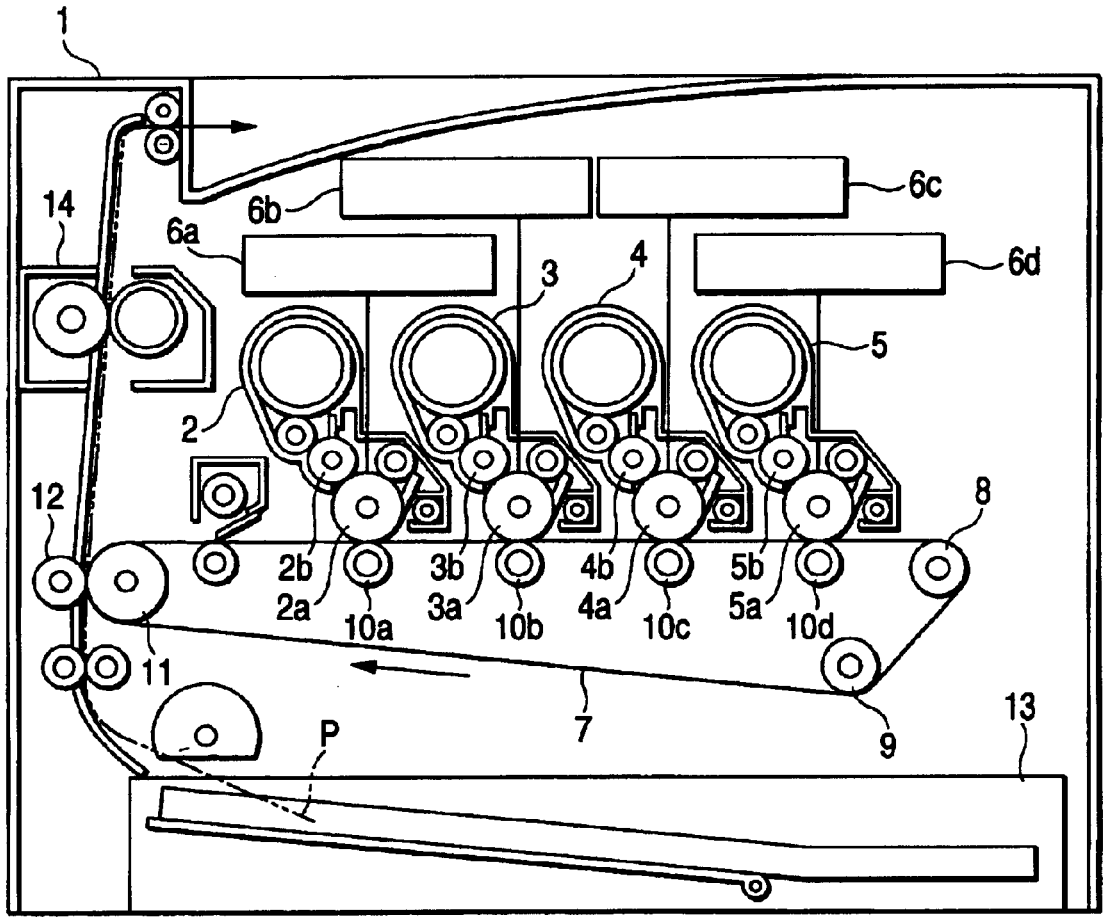
FIG. 1 is a schematic view showing the constitution of a color image forming apparatus according to an embodiment of the invention.

An embodiment of the invention will be described below with reference to FIGS. 1 to 5. In these figures, like members are given like reference characters, and the overlapping description is omitted.

Figure 2A:
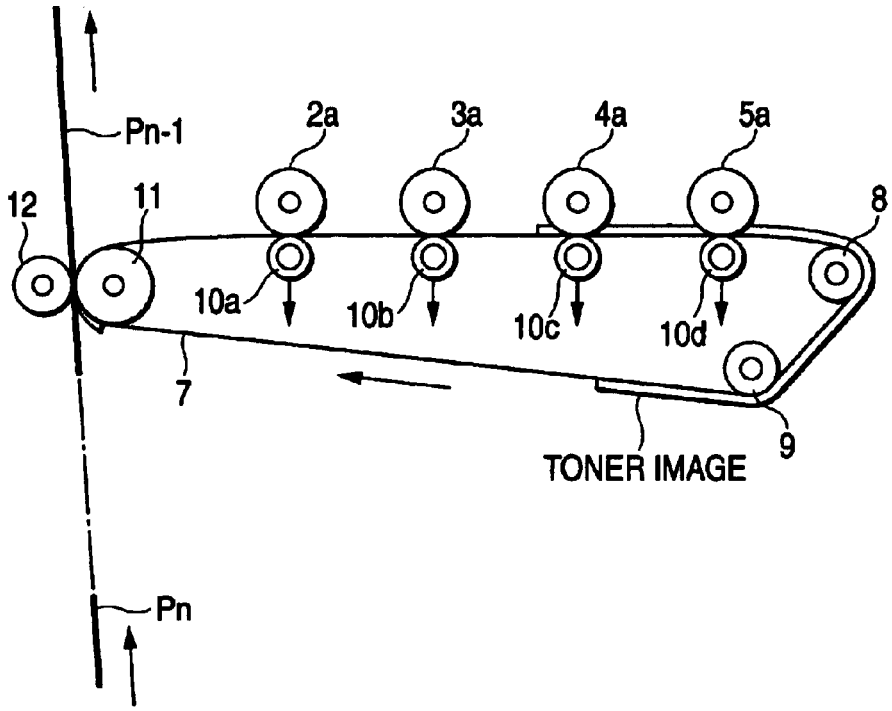
FIGS. 2A to 2D is an explanatory view showing continuously an operation state of a transfer section in the color image forming apparatus according to the embodiment of the invention.
Figure 2B:
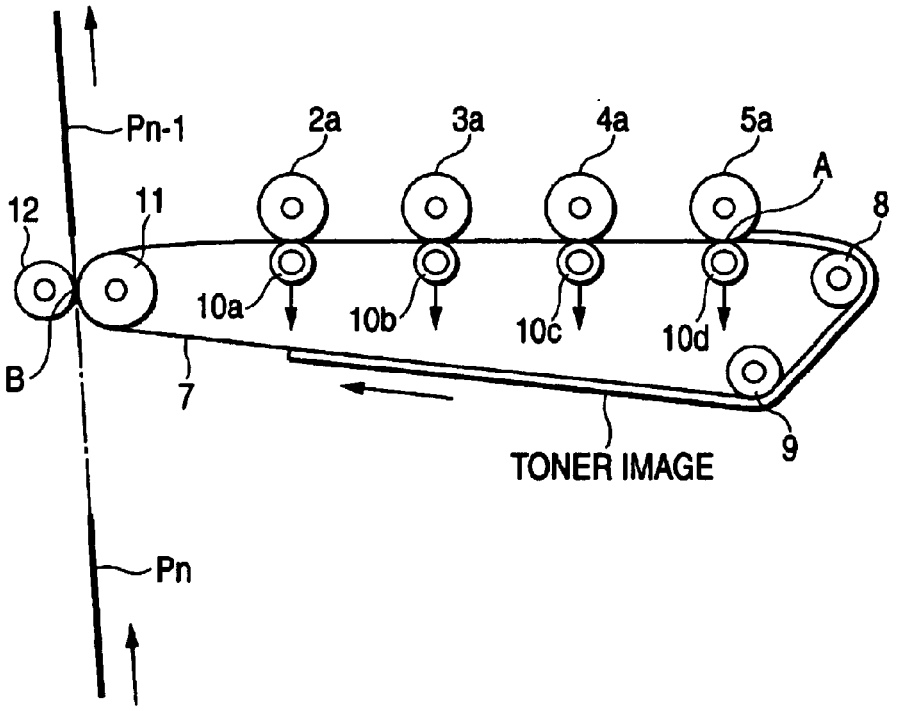
Figure 2C:
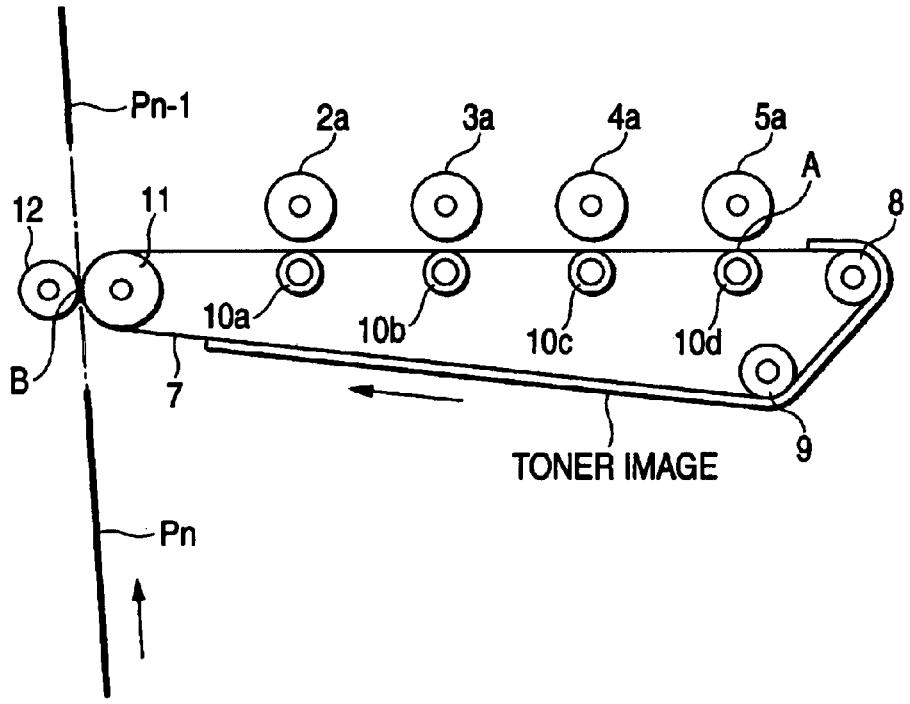
Figure 2D:
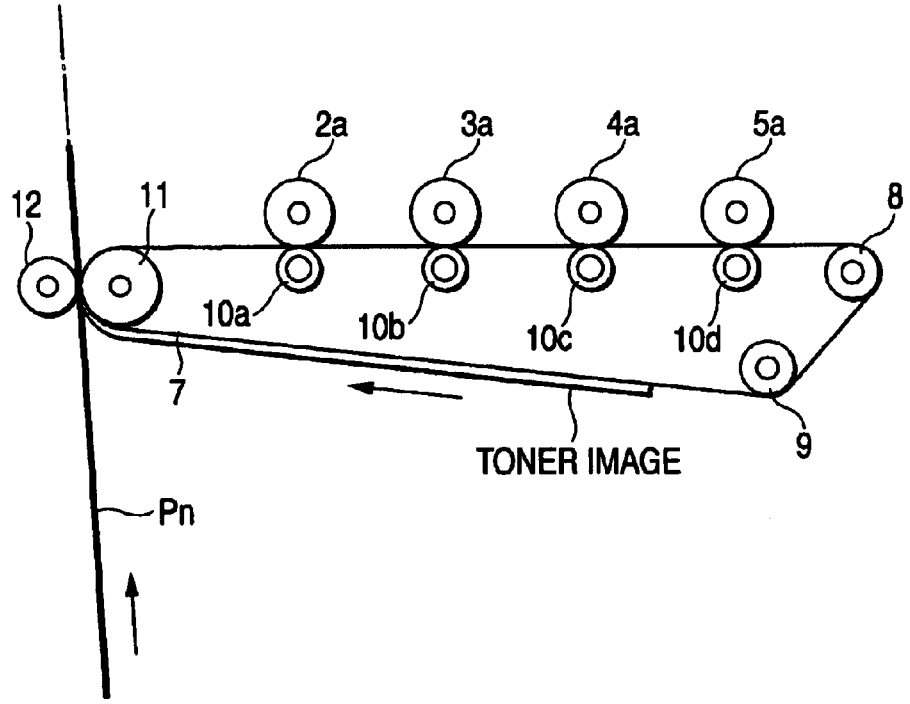
Figure 3A:
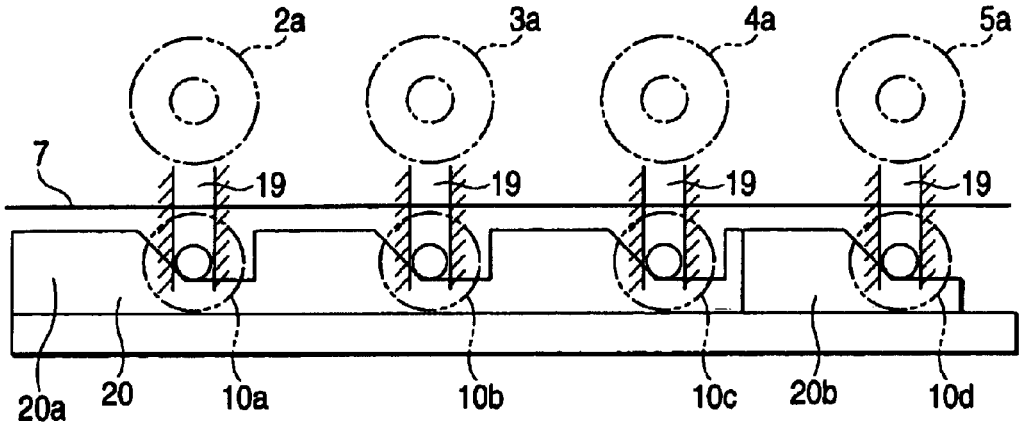
FIGS. 3A and 3B are explanatory views showing a lifting mechanism of first bias transfer roller in the color image forming apparatus of FIG. 1.
Figure 3B:
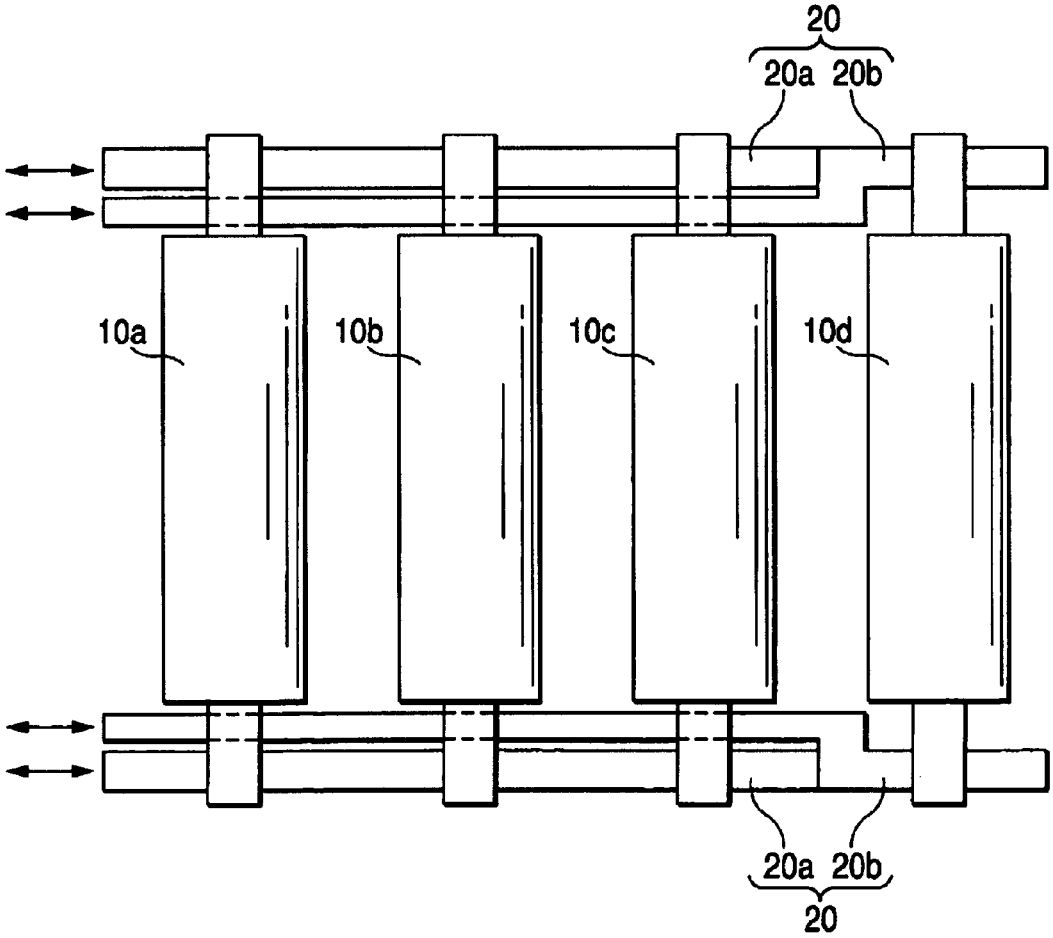
Figure 4:
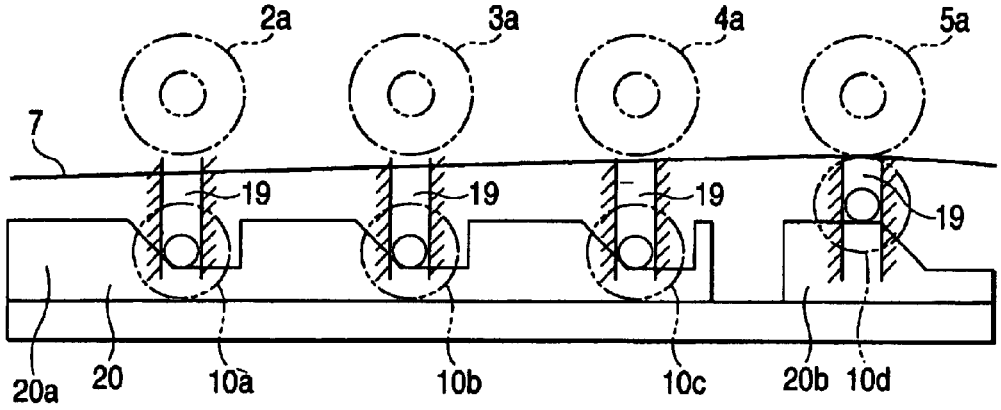
FIG. 4 is an explanatory view showing a state where a part of the first bias transfer rollers is located in a rise position in the lifting mechanism of FIGS. 3A and 3B.
Figure 5:
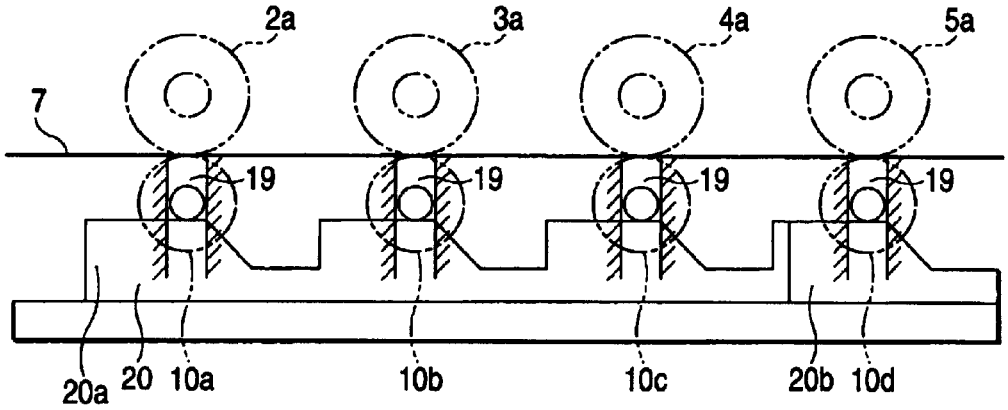
FIG. 5 is an explanatory view showing a state where all the first bias transfer rollers are located in the rise positions in the lifting mechanism of FIGS. 3A and 3B.
Figure 6:
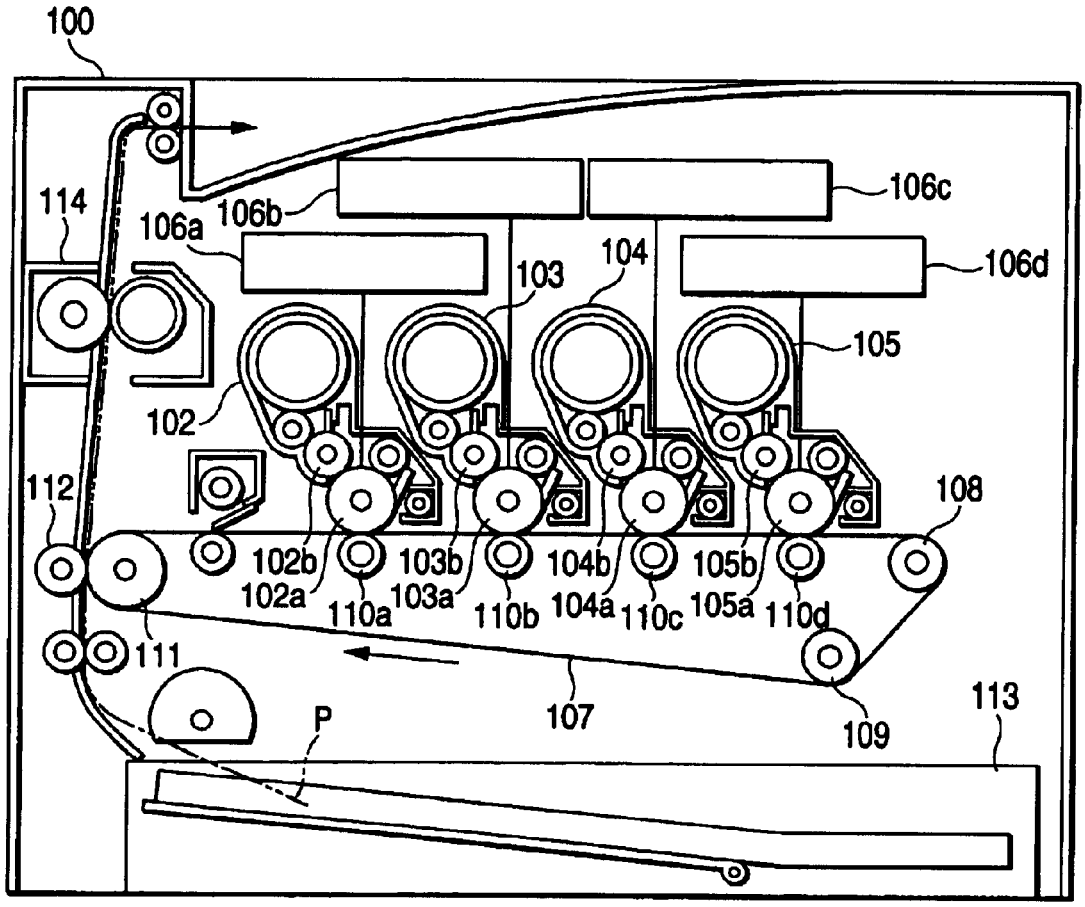
FIG. 6 is a schematic view showing the constitution of a conventional color image forming apparatus.
Figure 7A:
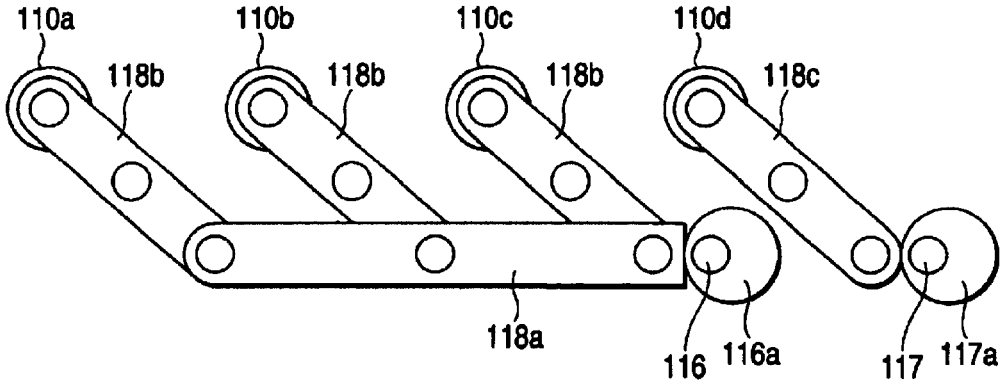
FIG. 7 is an explanatory view showing a lifting mechanism of first bias transfer roller which the inventor has investigated.
Figure 7B:
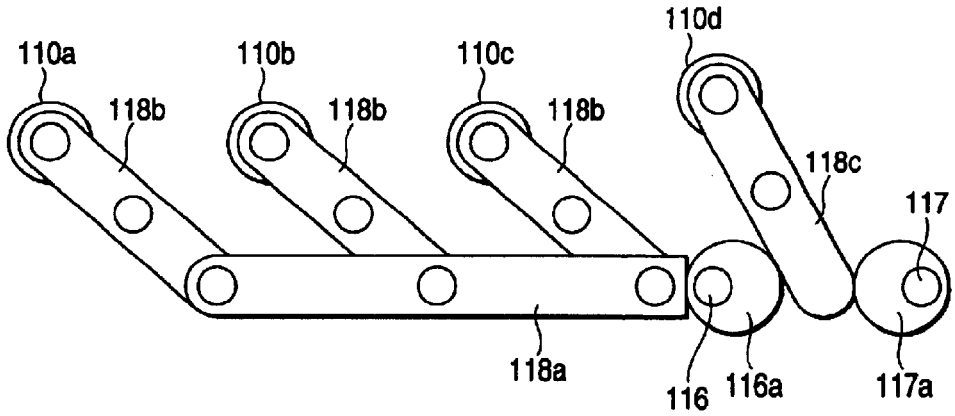
Figure 7C:
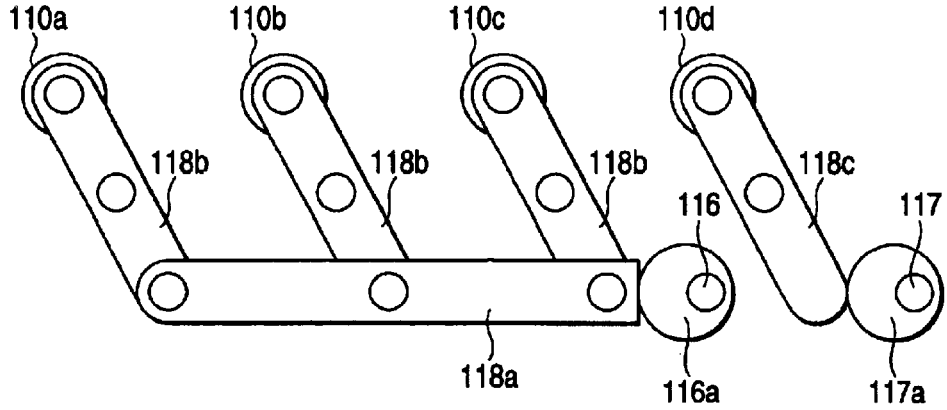

FIG. 1 is a schematic view showing the constitution of a color image forming apparatus according to one embodiment of the invention, FIGS. 2A to 2D are explanatory views showing continuously an operation state of a transfer section in the color image forming apparatus according to the embodiment of the invention, FIGS. 3A and 3B are explanatory views showing a lifting mechanism of first bias transfer roller in the color image forming apparatus of FIG. 1, FIG. 4 is an explanatory view showing a state where a part of the first bias transfer rollers is located in a rise position in the lifting mechanism of FIGS. 3A and 3B, and FIG. 5 is an explanatory view showing a state where all the first bias transfer rollers are located in the rise position in the lifting mechanism of FIGS. 2A and 3B.

In FIG. 1, in a body 1 of the color image forming apparatus, image forming units 2, 3, 4 and 5 for forming respectively toner images of each color of yellow (Y), magenta (M), cyan (C), and black (K) are arranged in order, and exposing devices 6*a*, 6*b*, 6*c*, and 6*d* corresponding to these respective image forming units 2 to 5 are provided. The image forming units 2 to 5 include photoconductor drums (photoconductors) 2*a*, 3*a*, 4*a*, and 5*a*, which are image bearing members, on peripheral surfaces of which electrostatic latent images are formed by irradiation of laser beams from the exposing devices 6*a* to 6*d*; and developing rollers 2*b*, 3*b*, 4*b*, and 5*b* which attach toner supplied from toner tanks onto the photoconductor drums 2*a* to 5*a* to make the electrostatic latent images visible as toner images. The photoconductor drums 2*a*, 3*a*, 4*a*, and 5*a* rotating in the peripheral direction are arranged in a line so that their rotary center shafts become parallel with one another.

On the lower side of the arranged image forming units 2 to 5, an endless intermediate transfer belt (intermediate transfer member) 7 on which a color toner image is to be formed by multi layer transferring the toner images of the respective colors made visible on the photoconductor drums 2*a*, 3*a*, 4*a*, and 5*a* is arranged so that it can run in the direction of an arrow. The intermediate transfer belt 7 includes in its loop a drive roller 8 which runs this intermediate transfer belt 7; a tension roller 9 which applies the predetermined tension to the intermediate transfer belt 7; four first bias transfer rollers 10*a*, 10*b*, 10*c* and 10*d* which are arranged correspondingly to each of the photoconductor drums 2*a* to 5*a*, and bring the intermediate transfer belt 7 into pressure contact with the respective photoconductor drums 2*a* to 5*a* thereby to transfer the toner images of each color on the photoconductor drums 2*a* to 5*a* onto the intermediate transfer belt 7, that is, which perform first bias transfer; and a driven roller 11 which rotates by rotation of the intermediate transfer belt 7 produced by the drive roller 8. The intermediate transfer belt 7 is driven in the direction of an arrow so as to rotate around these parts.

The tension roller 9, during printing, is energized by a spring (not shown) in the figure, and moves to the lower right thereby to apply tension to the intermediate transfer belt 7. Further, during no-printing, the tension roller 9 releases the application of the tension to the intermediate transfer belt 7 so that rolling traces caused by rolling of the intermediate transfer belt 7 around each roller in the same position for a long time do not leave.

At the lower portion of the apparatus, a paper supply cassette 13 storing paper (recording medium) P therein is provided. The paper P is fed out from the paper supply cassette 13 to a paper transport path one by one by a supply roller.

On the paper transport path, a second bias transfer 12 which comes into contact with the peripheral surface of the intermediate transfer belt 7 by the predetermined amount in the position of the driven roller 11 to transfer the color image formed on this intermediate transfer belt 7 onto the paper P, that is, to perform second bias transfer, and a fixing device 14 which fixes the color image transferred onto the paper P onto the paper P by pressure and heat produced by nip rotation of the rollers are arranged.

In the thus structured image forming apparatus, firstly on the photoconductor drum 2*a* of the image forming unit 2, a latent image of yellow component color in image data is formed. This latent image is made visible as a yellow toner image by the developing device having yellow toner, and transferred as the yellow toner image on the intermediate transfer belt 7 by the first bias transfer roller 10*a* (first bias transfer).

On the other hand, while the yellow toner image is being transferred onto the intermediate transfer belt 7, a latent image of magenta component color is formed in the image forming unit 3, and successively it is made visible as a magenta toner image by the developing unit 3*b* having magenta toner. Next, on the intermediate transfer belt 7 in which transfer of the yellow toner image in the image forming unit 2 has been already completed, the magenta toner image is transferred by the first bias transfer roller 10*b* in the image forming unit 3 (first bias transfer is performed), so that the yellow toner image and the magenta toner image are multilayered.

Also regarding a cyan toner image and a black toner image, image formation is similarly performed, and toner images of four colors are multilayer transferred on the intermediate transfer belt 7.

The color image formed on the intermediate transfer belt 7 is transferred in the lump onto paper P supplied from the sheet supply cassette 13 by the nip power between the driven roller 11 and the second bias transfer roller 12 (second bias transfer). Then, the transferred toner images are heat-fixed on the paper P by the fixing device 14, and a full color image is formed on this paper P. Thereafter, the paper P is exhausted.

Here, when $L1 \leqq L$, in which L is an intermediate transfer belt length from a transfer point A in the first bias transfer by the photoconductor drum 5*a* located at the most downstream side in the moving direction of the intermediate transfer belt 7 and by the intermediate transfer belt 7 to a transfer point B in the second transfer on the paper P in the moving direction of the intermediate transfer belt 7, and L1 is a maximum print length of an image (toner image) to be printed on one paper sheet P, the color image forming apparatus of this embodiment operates as follows:

Namely, when, printing is being performed on the paper P successively in a first print job, and second transfer is being performed on paper $P_{n-1}$ before one from the last paper, as shown in FIG. 2A, first bias transfer of toner images to be transferred on the last paper $P_n$ is being performed on the intermediate transfer belt 7.

Here, when $L1 \leqq L$, as shown in FIG. 2B, immediately after the all first bias transfer of the toner images to be transferred on the last paper $P_n$ has been completed and the toner images have passed through the transfer point A, the toner images are located between the transfer point A and the transfer point B. In this case, as shown in FIG. 2B, when the second transfer onto the paper $P_{n-1}$ before one from the last paper has been completed and the paper $P_{n-1}$ has passed through the transfer point B, an interval is provided till a leading end of the toner images on the intermediate transfer belt 7 to be transferred onto the last paper $P_n$ reaches the transfer point B.

In the interval, as shown in FIG. 2B, the first bias transfer rollers 10*a* to 10*d* move in the direction of an arrow and release of contact between the photoconductor drums 2*a* to 5*a* and the intermediate transfer belt 7 is started by the separation unit. Further, as shown in FIG. 2C, before the leading end of the toner images formed on the intermediate transfer belt 7 to be transferred on the last paper $P_n$ reaches the transfer point B, the separation is completed. The photoconductor drums 2*a* to 5*a* separating from the intermediate transfer belt 7 stop their rotation.

The tension roller 9 continues to apply tension to the intermediate transfer belt 7 also after the toner images on the photoconductor drums 2*a* to 5*a* have been transferred on the intermediate transfer belt 7. Thereafter, after the toner images on the intermediate transfer belt have been transferred on the paper $P_n$, the tension roller releases the application of tension.

Thereafter, as shown in FIG. 2D, according to a toner image supply timing by the intermediate transfer belt 7, the paper $P_n$ is fed, and the toner images are transferred onto the paper $P_n$ at the transfer point B by the second bias transfer roller 12.

Hereby, while the first bias rollers 10*a* to 10*d* are moving, the toner images on the intermediate transfer belt 7 are not transferred on the paper $P_n$; and after the application of tension by the tension roller 9 is released, the toner images on the intermediate transfer belt 7 are not transferred on the paper $P_n$. Therefore, the state change of the intermediate transfer belt 7 caused while the first bias transfer rollers 10*a* to 10*d* are moving or caused by release of the tension application does not affect transfer of the toner image on the intermediate transfer belt 7 onto the paper $P_n$. Further, the photoconductor drums 2*a* to 5*a*, without waiting completion of the first print job, separates from the intermediate transfer belt 7 when the first bias transfer on the last paper $P_n$ is completed.

Accordingly, the state change of the intermediate transfer belt 7 caused by separation between the intermediate transfer belt 7 and the photoconductor drums 2*a* to 5*a* does not have an influence on printing, and while the transfer registration error is prevented, lives of the photoconductor 2*a* to 5*a* can be prolonged.

In the above description, the separation unit separates the photoconductor drums 2*a* to 5*a* and the intermediate transfer belt 7 from each other by an operation (first operation) in which the first bias transfer rollers 10*a* to 10*d* are moved in a direction separating from the intermediate transfer belt 7. However, by an operation (second operation) in which the photoconductor drums 2*a* to 5*a* are moved in a direction separating from the intermediate transfer belt 7, the separation unit may separate the photoconductor drums 2*a* to 5*a* and the intermediate transfer belt 7 from each other. Further, by both of the first and second operations, the separation unit may separate the photoconductor drums 2*a* to 5*a* and the intermediate transfer belt 7 from each other.

Further, in case that a maximum print length of an image (toner image) to be printed on one paper sheet P is longer than the intermediate transfer belt length from the transfer point A in the first bias transfer by the photoconductor drum 5*a* located at the most downstream side in the moving direction of the intermediate transfer belt 7 and by the intermediate transfer belt 7 to the transfer point B in the second transfer on the paper P in the moving direction of the intermediate transfer belt 7, the separation unit does not perform such the operation. Therefore, the photoconductor drums 2*a* to 5*a* do not separate from the intermediate transfer belt 7, or separate from it after the first print job has been completed.

In such the color image forming apparatus, the first bias transfer rollers 10*a* to 10*d* move to two positions up and down. One of their positions is a contact position where the first bias transfer rollers bring the intermediate transfer belt 7 into pressure contact with the photoconductor drums 2*a* to 5*a*, and the other is a separation position where the first bias transfer rollers separate the intermediate transfer belt 7 from the photoconductor drums 2*a* to 5*a*.

Here, a lifting mechanism of the first bias transfer rollers 10 to 10 will be described with reference to FIGS. 3A to 5.

As shown in FIGS. 3A and 3B, in the first bias transfer rollers 10*a* to 10*d*, their rotary shafts are fitted into guide grooves 19. The guide groove 19 is formed in the up-and-down direction. The first bias transfer rollers 10*a* to 10*d* move in such these guide grooves 19, whereby they can move to the two positions comprising the contact position where the first bias transfer rollers bring the intermediate transfer belt 7 into pressure contact with the photoconductor drums 2*a* to 5*a*, and the separation position where the first bias transfer rollers separate the intermediate transfer belt 7 from the photoconductor drums 2*a* to 5*a*.

Further, in the first bias transfer rollers 10*a* to 10*d*, their both ends are supported by cam noses of a lift drive section 20 which raises or lets down the first bias transfer rollers 10*a* to 10*d* along the guide grooves 19. The lift drive section 20 is provided in the arrangement direction of the first bias transfer rollers 10*a* to 10*d* so that it can reciprocate linearly, and the positions of the cams supporting the first bias transfer rollers 10*a* to 10*d* change by the movement of the lift drive section 20, whereby the first bias transfer rollers 10*a* to 10*d* are moved to the contact position or the separation position.

The lift drive section 20 comprises a first drive portion 20*a* and a second drive portion 20*b*. The first drive portion 20*a* raises or lets down the first bias transfer rollers 10*a* to 10*c* respectively corresponding to the photoconductor drums 2*a* to 4*a* on which the yellow, magenta, and cyan toner images are respectively formed. The second drive portion 20*b* raises or lets down the first bias transfer roller 10*d* corresponding to the photoconductor drum 5*a* on which the black toner image is formed.

As shown in FIGS. 3A, 3B and 4, the second drive portion 20*b* can raise or let down the first bias transfer roller 10*d* independently of the first drive portion 20*a*.

Further, as shown in FIGS. 3A, 3B and 5, when the first drive portion 20*a* moves so as to move the first bias transfer rollers 10*a* to 10*c* to the contact position, it comes into contact with the second drive portion 20*b*, whereby it moves this second drive portion 20*b* to the position where the first bias transfer roller 10*d* comes into contact with the belt 7.

Under this structure, when an instruction is given so that only the black image forming unit 5 operates in case that a monochrome image is formed, a drive motor (not shown) operates, and only the second drive portion 20*b* of the lift drive section 20 moves. As shown in FIG. 4, a cam support position of only the first bias transfer roller 10*d* is being heightened gradually, whereby the first bias transfer roller 10*d* rises along the guide groove 19 and brings the intermediate transfer belt 7 into contact with the photoconductor drum 5*a*.

Further, when an instruction is given so that all the image forming units 2 to 5 operate in case that a color image is formed, the first drive portion 20*a* of the lift drive section 20 moves and pushes the second drive portion 20*b*, so that the second drive portion 20*b* also move. As shown in FIG. 5, the cam support positions of all the first bias transfer rollers 10*a* to 10*d* are being heightened gradually, whereby the first bias transfer rollers 10*a* to 10*d* rise along the guide grooves 19 and bring the intermediate transfer belt 7 into contact with the photoconductor drums 2*a* to 5*a*.

As described above, according to the embodiment, the first bias transfer rollers 10*a* to 10*d* are raised or let down by the cam noses formed at the lift drive section reciprocating linearly. Therefore, the lifting amount of the first bias transfer rollers 10*a* to 10*d* is determined by height of the cam nose, so that the height of contact of the first bias transfer rollers 10*a* to 10*d* with the intermediate transfer belt 7 can be controlled at high accuracy.

In the above description, the lift drive section 20 is separated into the first drive portion 20*a* and the second drive portion 20*b* in order to stop the operation of the photoconductor drums 2*a* to 4*a* used in only color image formation when a monochrome image is formed. However, the lift drive section 20 may be formed integrally to raise and let down all the first bias transfer rollers 10*a* to 10*d* simultaneously.

Figure 8:
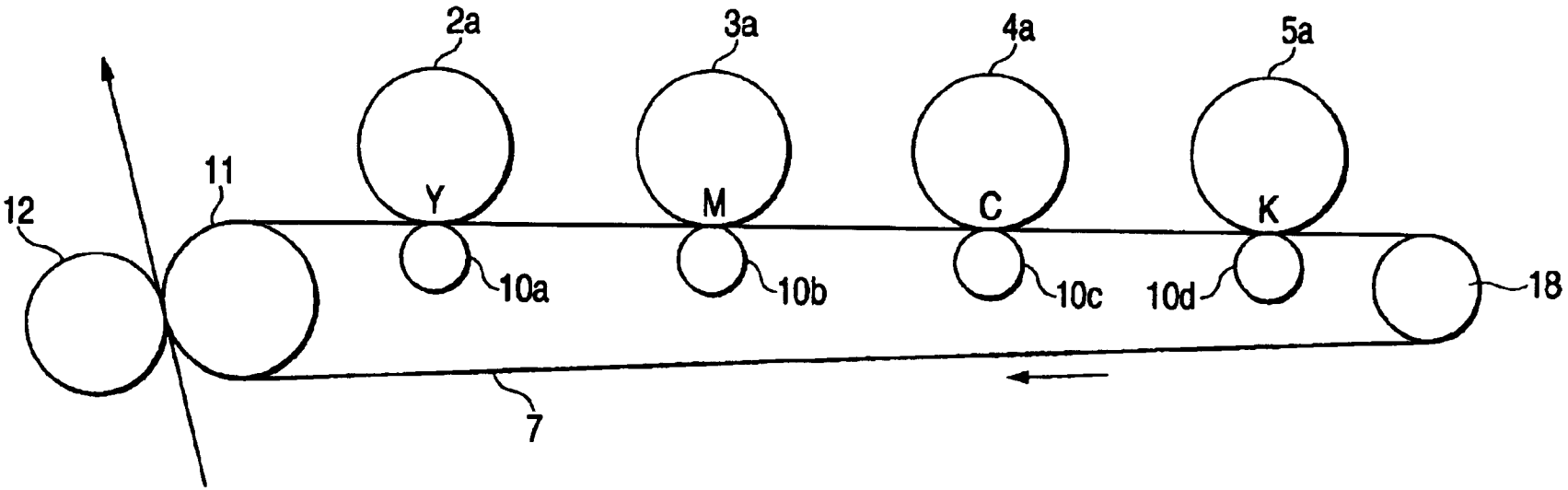
FIG. 8 shows another example of the present invention.

Additionally, FIG. 8 shows another example of the present invention. In this example, a tension roller 9 is omitted because a driving roller 18 also functions as a tension roller.

As described above, according to the invention, after all the first bias transfer in the first print job has been completed, before the last second bias transfer is started, and after second transfer on the recording medium before one from the last recording medium has been completed, the photoconductor and the intermediate transfer member are separated from each other. Therefore, there can be obtained effective advantage that the state change of the intermediate transfer member due to separation between the intermediate transfer member and the photoconductor has no influence on printing, so that the transfer registration error can be prevented and the photoconductor's life can be prolonged.

As described above, according to the invention, since the first bias transfer roller is raised or let down by the cam nose formed at the lift drive section reciprocating linearly, the lifting amount of the first bias transfer roller is determined by height of the cam nose, so that the height of contact of the first bias transfer roller with the intermediate transfer member can be controlled at high accuracy.

Further, the second drive portion raises and lets down first bias transfer roller independently of the first drive portion, and when the first drive portion moves so as to move the first bias transfer roller to the contact position, the second drive portion is moved by the first drive portion and moves the first bias transfer roller to the contact position. Hereby, when a monochrome image is formed, it is possible to stop the operation of the photoconductors used in only color image formation.

What is claimed is:

1. A color image forming apparatus comprising:

a plurality of photoconductors arranged in a line so that their rotary center shafts become parallel with one another and rotating in the peripheral direction, on which electrostatic latent images corresponding to toner images of each color are formed respectively;

developing units provided respectively correspondingly to said photoconductors and making said electrostatic latent images formed on said photoconductors visible to form toner images;

an endless intermediate transfer member arranged in a contactable state with said photoconductors to run;

first bias transfer rollers which are arranged in a loop of said intermediate transfer member correspondingly to each photoconductor, and bring said intermediate transfer member into pressure contact with said photoconductors thereby to transfer the toner images of each color on said photoconductor onto said intermediate transfer member, that is, to perform first bias transfer;

a second bias transfer roller which presses a recording medium against said intermediate transfer member thereby to transfer the toner image transferred on said intermediate transfer member onto said recording medium, that is, to perform second bias transfer; and a separation mechanism which, when a maximum print length of an image to be printed on one recording medium is below a length from a transfer point of the first bias transfer located on the most downstream side in the moving direction of said intermediate transfer member to a transfer point of second bias transfer in the moving direction of said intermediate transfer member, separates said photoconductor and said intermediate transfer member from each other during a period after all first bias transfer of the toner image to be transferred on a last recording medium in a first print job has been completed, before second bias transfer onto the last recording medium is started and after second bias transfer onto a recording medium immediately before the last recording medium has been completed.

2. The color image forming apparatus according to claim 1, wherein said separation unit separates said intermediate transfer member and said photoconductor from each other by at least any one of a first operation in which said first bias transfer roller is moved in a direction separating from said intermediate transfer member, and a second operation in which said photoconductor is moved in a direction separating from said intermediate transfer member.

3. The color image forming apparatus according to claim 2, wherein said photoconductor stops its rotation after it has separated from said intermediate transfer member.

4. The color image forming apparatus according to claim 1, wherein said photoconductor stops its rotation after it has separated from said intermediate transfer member.

5. A color image forming apparatus comprising:

a plurality of photoconductors arranged in a line so that their rotary center shafts become parallel with one another and rotating in the peripheral direction, on which toner images of each color are formed respectively;

an endless intermediate transfer member arranged in a contactable state with said photoconductors to run;

a plurality of first bias transfer rollers which are respectively arranged in a loop of said intermediate transfer member correspondingly to each photoconductor, and bring said intermediate transfer member into pressure contact with said photoconductors thereby to transfer the toner images of each color on said photoconductors onto said intermediate transfer member;

guide grooves into which rotary shafts of said first bias transfer rollers are fitted, which can move said first bias transfer roller to two positions comprising a contact position where said intermediate transfer member is brought into pressure contact with said photoconductors and a separation position where said intermediate transfer member is separated from said photoconductors; and a lift drive section which is provided so that it can reciprocate linearly in the arrangement direction of the plural first bias transfer rollers and which has cam noses supporting said rotary shafts of said first bias transfer rollers, and raising and letting down said first bias transfer rollers along said guide grooves thereby to move the first bias transfer roller to said contact position or said separation position, wherein said lift drive section includes a first drive portion for raising and letting down said first bias transfer rollers respectively corresponding to said photoconductors on which toner images of yellow, magenta, and cyan are formed, and a second drive portion for raising and letting down said first bias transfer roller corresponding to said photoconductor on which a toner image of black is formed; and said second drive portion raises and lets down said first bias transfer roller independently of said first drive portion, and when said first drive portion moves so as to move said first bias transfer roller to said contact position, said second drive portion is moved by the first drive portion and moves said first bias transfer roller to said contact position.

6. A image forming apparatus comprising:

a photoconductor on which a toner image is formed;

a loop-like intermediate transfer member which is arranged in a contactable state with said photoconductor to run;

a first bias transfer roller which brings said intermediate transfer member into pressure contact with said photoconductor and transfers the toner image formed on said photoconductor onto said intermediate transfer member thereby to perform first bias transfer; and a separation mechanism which separates said intermediate transfer member and said photoconductor from each other immediately after a transferring an image for a final page in a multiple-page single print job from said photoconductor to said intermediate transfer member.

7. The image forming apparatus according to claim 6, wherein plural photoconductors and plural first bias transfer rollers are provided, and said separation mechanism separates said intermediate transfer member and said photoconductor from each other immediately after a final transferring of said image from the photoconductors to said intermediate transfer member.

8. The image forming apparatus according to claim 7, further comprising a second bias transfer roller which transfers said toner image formed on said intermediate transfer member onto a recording medium, that is, performs second bias transfer, wherein said intermediate transfer member and said photoconductor are separated from each other after second bias transfer onto a page that is immediately before said final page has been completed and after said first bias transfer for said final page has been completed.

9. A color image forming apparatus comprising:

a plurality of photoconductors arranged in a line so that their rotary center shafts become parallel with one another and rotating in the peripheral direction, on which toner images of each color are formed respectively;

an endless intermediate transfer member arranged in a contactable state with said photoconductors to run;

a plurality of first bias transfer rollers which are respectively arranged in a loop of said intermediate transfer member correspondingly to each photoconductor, and bring said intermediate transfer member into pressure contact with said photoconductors thereby to transfer the toner images of each color on said photoconductors onto said intermediate transfer member;

guide grooves into which rotary shafts of said first bias transfer rollers are fitted, which can move said first bias transfer roller to two positions comprising a contact position where said intermediate transfer member is brought into pressure contact with said photoconductors and a separation position where said intermediate transfer member is separated from said photoconductors; and a lift drive section which is provided so that it can reciprocate linearly in the arrangement direction of the plural first bias transfer rollers and which has cam noses supporting said rotary shafts of said first bias transfer rollers, and raising and letting down said first bias transfer rollers along said guide grooves thereby to move the first bias transfer roller to said contact position or said separation position wherein said lift drive section separates said intermediate transfer member and said photoconductor from each other immediately after first bias transfer on the last recording medium in a first print job has been completed.

10. The image forming apparatus according to claim 9 further comprising a second bias transfer roller which transfers said toner image formed on said intermediate transfer member onto a recording medium, that is, performs second bias transfer, wherein said intermediate transfer member and said photoconductor are separated from each other after second bias transfer onto a recording medium immediately before said last recording medium has been completed and after said first bias transfer on said last recording medium has been completed, wherein said lift drive section includes a first drive portion for raising and letting down said first bias transfer rollers respectively corresponding to said photoconductors on which toner images of yellow, magenta, and cyan are formed, and a second drive portion for raising and letting down said first bias transfer roller corresponding to said photoconductor on which a toner image of black is formed; and said second drive portion raises and lets down said first bias transfer roller independently of said first drive portion, and when said first portion moves so as to move said first bias transfer roller to said contact position, said second drive portion is moved by the first drive portion and moves said first bias transfer roller to said contact position.

* * * * *